United States Patent [19]

Berg

[11] Patent Number: 4,793,819

[45] Date of Patent: Dec. 27, 1988

[54] OVER-THE-ROAD VEHICLE ELECTRICAL CONNECTOR WITH DRAIN PASSAGE

[75] Inventor: Arthur A. Berg, Northbrook, Ill.

[73] Assignee: Sloan Valve Company, Franklin Park, Ill.

[21] Appl. No.: 17,135

[22] Filed: Feb. 20, 1987

[51] Int. Cl.[4] ..... H01R 13/44

[52] U.S. Cl. ..... 439/142; 174/67; 439/205

[58] Field of Search ..... 339/44 R, 44 M, 117 R, 339/36; 174/67; 220/242; 439/135, 136, 142, 205

[56] References Cited

U.S. PATENT DOCUMENTS

| | | | |
|---|---|---|---|
| 3,478,297 | 11/1969 | Gimpel et al. | 439/205 |
| 3,887,256 | 6/1975 | Klimek et al. | 339/44 M |
| 4,037,907 | 7/1977 | Klimek et al. | 339/44 M |
| 4,106,834 | 8/1978 | Horowitz | 339/44 M |
| 4,138,187 | 2/1979 | Brugger | 339/44 R |

*Primary Examiner*—Gil Weidenfeld
*Assistant Examiner*—Paula A. Austin
*Attorney, Agent, or Firm*—Kinzer, Plyer, Dorn, McEachran & Jambor

[57] ABSTRACT

An electrical connector receptacle for use in over-the-road vehicles includes a receptacle body and a mounting flange extending outwardly from the body, with the mounting flange adapted to be mounted in a generally vertical disposition on a vehicle. The body has a closed end and a chamber, with the chamber having an axis generally perpendicular to the plane of the mounting flange. There are a plurality of electrical contact pins mounted on the body closed end which extend into the chamber. The chamber has an open end and a cover pivotally mounted on the body to close the chamber open end. There is a drain passage formed in the bottom of the chamber and extending generally axially for a substantial portion of the length of the chamber. The drain passage slants downwardly from adjacent the body closed end to the body open end.

4 Claims, 1 Drawing Sheet

OVER-THE-ROAD VEHICLE ELECTRICAL CONNECTOR WITH DRAIN PASSAGE

SUMMARY OF THE INVENTION

The present invention relates to electrical connectors and particularly to an electrical connector receptacle for use on over-the-road vehicles.

A primary purpose of the invention is an electrical connector for the use described which has a drain passage open whenever a plug is inserted within the receptacle, which drain passage in no way affects the secure mounting of the plug within the receptacle.

Another purpose is an electrical connector receptacle of the type described including a drain passage open when a plug is positioned within the connector, which drain passage slopes downwardly to insure removal of moisture from within the receptacle during use.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
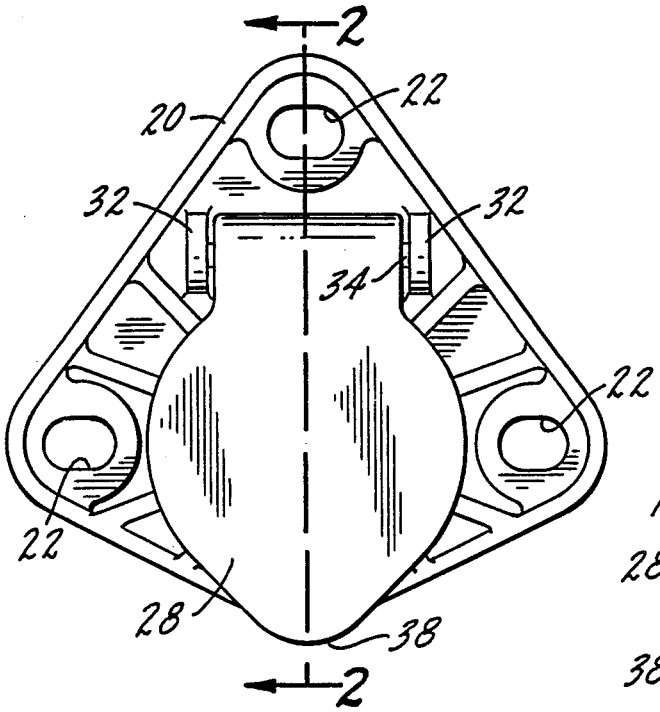
FIG. 1 is a front view of an electrical connector receptacle.

The present invention relates to electrical connectors of the type used on over-the-road vehicles such as tractor-trailer combinations. Such connectors are normally mounted on the vehicle in a manner to be exposed to the weather. If moisture is allowed to accumulate within the connector receptacle, when the plug is inserted therein, there is the possibility for a short in the vehicle electrical circuits. Thus, it is important to insure adequate drainage from the connector receptacle and particularly when it has a male plug inserted therein.

Prior electrical connectors for the use described have utilized a slightly non-vertical mounting for the connector receptacle which insures that the receptacle body chamber will have a slight downward disposition so that any moisture accumulating in the receptacle body chamber will be naturally drained when a plug is inserted therein. However, such an arrangement has the distinct disadvantage that if the plug becomes at all loose within the receptacle due to the normal vibration which attends vehicle operation, the plug will fall out of the receptacle, thus breaking the electrical connection.

The present invention provides a drain for the receptacle body which is closed by the receptacle cover when there is no plug inserted in the receptacle and which drain passage has a downward disposition to normally drain whenever the connector receptacle is open and a plug is inserted therein.

U.S. Pat. No. 4,113,333, assigned to the assignee of the present application, shows a connector receptacle of the general type disclosed herein. The receptacle includes a body 10, generally cylindrical in cross section, and including a closed end 12 and an open end 14. There is a chamber 16 formed within receptacle body 10 and a plurality of contact pins 18 are mounted in closed receptacle end 12 and extend within chamber 16.

A mounting flange 20 extends outwardly from body 10 and may be integral with the casting that forms the body. The flange may be a separate element, but generally a single casting for the flange and the body is preferred. Flange 20 may have a plurality of mounting holes 22 which are used to mount the receptacle to a vehicle body. The flange will be mounted in a vertical disposition on the vehicle body and chamber 16 has an axis indicated at 24 which is generally horizontal and perpendicular to the plane of flange 20.

Figure 3:
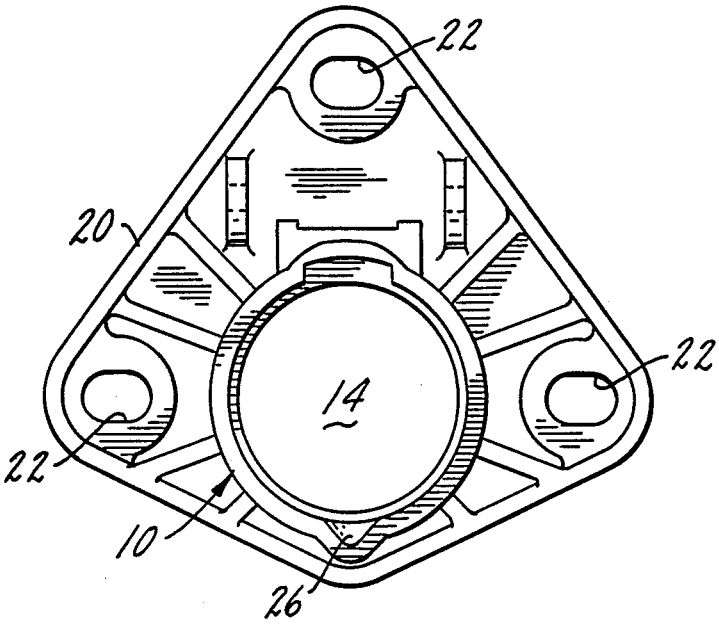
FIG. 3 is a front view of the receptacle body, with the contact pin assembly removed.

Formed in the bottom of body 10 generally at the center thereof is a drain passage 26 which has a generally V-shaped or wedge-shaped configuration, as particularly illustrated in FIG. 3. The drain passage has a downward slant, for example approximately 5°, and begins generally at the closed end 12 of the body and gradually increases in depth and in width in a direction toward open end 14 of body 10. Thus, the drain passage slants downwardly when flange 20 mounts the connector receptacle in a generally vertical disposition. Not only does the drain passage slant downwardly, but the passage increases in size, both in depth and in width, from its beginning toward its termination at the open end 14 of body 10.

Figure 2:
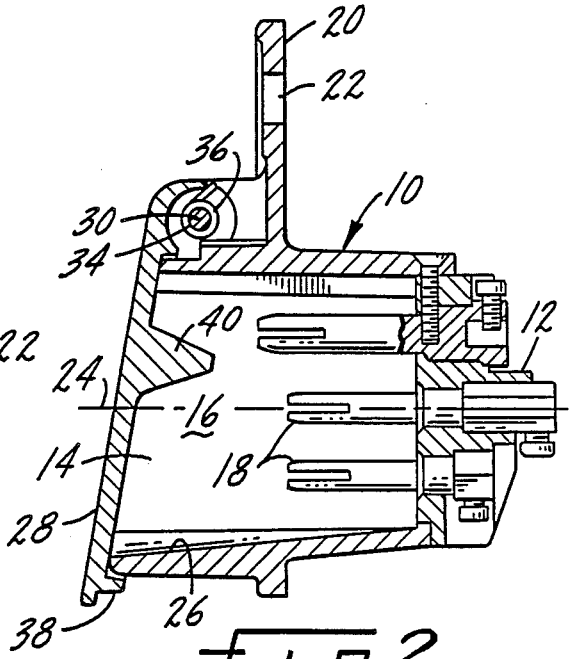
FIG. 2 is an axial vertical section through the connector receptacle of FIG. 1.

The open end 14 of the receptacle body is closed by a cover 28 which is pivotally mounted, as at 30, to the top of body 10. The pivotal mounting includes a pair of upstanding arms 32 holding a shaft 34 about which is mounted a coil spring 36 which normally biases cover 28 to the closed position of FIG. 2. The cover has a generally circular shape except for the lower portion thereof, indicated at 38, which is formed and adapted to cover drain passage 26 when the cover is in the closed position. The inside of cover 28 may have a locking element 40 which is formed and adapted to interlock with a plug inserted within the receptacle to hold the plug in such inserted position.

When the receptacle is not mounting a plug, cover 28 will be closed and drain passage 26 will be masked by the cover. When a plug is inserted within the receptacle, the cover is raised and the plug, generally cylindrical in cross section, will not obstruct drain passage 26. Rather, passage 26 will be open beneath the plug to insure that any moisture accumulating within the receptacle from weather conditions will be normally drained out of the receptacle.

The plane of open end 14 of body 10 forms an angle other than 90° with axis 24 of chamber 16. Cover 28, which lies in the plane of the opening when the cover is closed, will form a similar angle with the axis of the chamber and with the receptacle body. Such a configuration provides a receptacle body which has added bottom support for the connector plug, insuring against accidental removal of the plug from the receptacle.

The number of mounting openings in the mounting flange may vary, as may the number of pins held in the connector closed end. What is important in the present invention is the drain passage, its unique configuration and position.

Whereas the preferred form of the invention has been shown and described herein, it should be realized that there may be many modifications, substitutions and alterations thereto.

The embodiments of the invention in which an exclusive property or privilege is claimed are defined as follows:

1. An electrical connector receptacle for use in over-the-road vehicles including a receptacle body, a mounting flange extending outwardly from said body and adapted to be mounted in a generally vertical disposition on a vehicle, said body having a closed end and a chamber, with said chamber having an axis generally perpendicular to the plane of said mounting flange, a plurality of contact pins mounted on said body closed end and extending into said chamber, said chamber having an open end and a cover pivotally mounted on said body to close said chamber open end, and a defined inclined drain passage formed in the bottom of said chamber and extending axially a substantial portion of said chamber, said drain passage extending below the bottom of said chamber and slanting downwardly from adjacent said body closed end to an opening at said body open end.

2. The electrical connector receptacle of claim 1 further characterized in that said cover is spring-biased toward a position closing said chamber open end, with said cover masking said drain passage when in the closed position.

3. The electrical connector receptacle of claim 1 further characterized in that said cover, when closed upon said body open end, forms an angle other than 90 degrees with the axis of said body chamber.

4. The electrical connector receptacle of claim 3 further characterized in that the open end of said body lies in a plane forming an angle other than 90° with the axis of said chamber.

* * * * *